US005199340A

United States Patent [19]

Lamson

[11] Patent Number: 5,199,340

[45] Date of Patent: Apr. 6, 1993

[54] MECHANICAL PARTS EJECTOR FOR TRIM PRESS

[75] Inventor: Wayne Lamson, Beaverton, Mich.

[73] Assignee: John Brown Inc., West Warwick, R.I.

[21] Appl. No.: 705,589

[22] Filed: May 24, 1991

[51] Int. Cl.[5] ..... B26D 7/18

[52] U.S. Cl. ..... 83/82; 83/97; 83/125; 83/128; 83/135; 83/405

[58] Field of Search ..... 83/23, 50, 81, 82, 85, 83/94, 97, 123, 125, 126, 127, 128, 135, 405

[56] References Cited

U.S. PATENT DOCUMENTS

| | | | |
|---|---|---|---|
| 1,097,727 | 5/1914 | Ohliger | 83/127 |
| 3,461,760 | 8/1969 | White | 83/81 |
| 4,068,520 | 1/1978 | Carrieri | 83/125 X |
| 4,313,358 | 2/1982 | Brown | 83/97 |
| 4,391,171 | 7/1983 | Wendt | 83/97 X |

*Primary Examiner*—Frank T. Yost
*Assistant Examiner*—Raymond D. Woods
*Attorney, Agent, or Firm*—Burnett W. Norton

[57] ABSTRACT

Apparatus for trimming and ejecting articles integrally thermoformed in a sheet of thermoplastic material from the sheet including a pair of opposed trim dies which will trim parts out of a web of thermoplastic material. Apparatus is provided for pushing the trimmed parts out of the trimming station at a greatly accelerated rate. The apparatus includes a pusher member reciprocally movable in a to-and-fro path of travel between a retracted position and a forward ejecting position. Apparatus is provided for moving the ejector mechanism in the to-and-fro path and includes a toggle linkage mechanism which engages a cam for movement between relatively folded positions on one side of a plane and relatively oppositely folded positions on the opposite side of the plane to rapidly advance and even more rapidly retract the pusher member.

32 Claims, 5 Drawing Sheets

MECHANICAL PARTS EJECTOR FOR TRIM PRESS

BACKGROUND OF THE INVENTION

1. Field of the Invention

This invention relates to a trim press for severing articles from a sheet of thermoplastic material in which articles have been differentially pressure formed and more particularly to a trim press including new and novel variable speed ejector mechanism for initially slowly ejecting a severed article from the sheet, increasing the ejection velocity as the ejector mechanism moves the severed article to its fully downstream ejecting position, and then even more rapidly retracting the ejector mechanism to its starting position.

2. Description of the Prior Art and Objects

Apparatus, such as that disclosed in U.S. Pat. No. 3,664,791, granted to G. W. Brown on May 23, 1972, which is incorporated herein by reference, has been provided heretofore for successively delivering a heated thermoplastic sheet to a sheet heating station, then to a forming station at which opposed die parts engage the sheet to differentially pressure form three dimentional articles in the sheet, and then to a trim station at which articles are severed from the sheet.

U.S. Pat. No. 4,313,358, granted to Gaylord W. Brown on Feb. 2, 1982, which is incorporated herein by reference, discloses a reciprocally movable trim die assembly including hollow cylindrical die knives and an opposed reciprocally moving trim die having trim punches which move between remote positions in which the sheet is indexed to the trim station and sheet trimming positions, engaging opposite sides of the sheet, to trim articles positioned at the trim station. The latter mentioned patent discloses article ejectors mounted in hollow die punches for movement relative thereto between retracted positions received by the hollow die punches, when the die assemblies are in the spaced apart positions, and advanced, ejecting positions projecting from the hollow punches after the articles are severed from the sheet.

The ejectors disclosed in the latter mentioned patent are driven via a cam and cam follower assembly which essentially "hammers" the ejector to the projected, ejecting position. Such "hammering" causes substantial loading, which can have a dilatorious effect on the machine bearings.

High speed ejection with a very high speed ejector which "hammers" the part, can crush the part upon impact. Such "hammering" can sometimes propel the part far beyond that which would normally be desired. It has been found advantageous to initially contact the part with a slowly moving ejector, and then increasing the velocity as the part is moved downstream. Accordingly, it is an object of the present invention to provide new and novel apparatus for trimming and ejecting parts integrally thermoformed in a sheet of thermoplastic material from the sheet which will rapidly eject a part without damaging the part.

It is another object of the present invention to provide a new and novel apparatus for trimming and ejecting articles integrally thermoformed in a sheet of thermoplastic material from the sheet which will start the ejection at a relatively low velocity, increase the velocity as it moves downstream and then even more rapidly retract the ejector to increase production.

U.S. Pat. No. 4,391,171, granted to Michael Wendt on Jul. 5, 1983, discloses a trim press including an ejector which is mounted on the trim die propelling apparatus for movement therewith and relative thereto. The article ejector in the latter mentioned patent is mounted on the moving die assembly for movement therewith and mechanism is provided for moving the article ejector relative to the moving trim die including a set of levers and associated eccentric cams which are actuated in timed relation.

Some of the prior art trim presses have incorporated cam boxes for controlling the movement of the ejector rods relative to the trim platen. There is a limitation on the operational speed of a system employing cam boxes which are relatively complicated and relatively difficult to be understood by users in the field.

Accordingly, it is a further object of the present invention to provide method and apparatus for actuating part ejector rods which will be more readily and easily understood, operated and repaired by users.

Another problem typically faced with the prior art trim presses having part ejectors is the loss of production time which occurs while the part ejector is positioned in the path of the sheet. Accordingly, it is another object of the present invention to provide new and novel apparatus for trimming and ejecting parts integrally thermoformed in a sheet of thermoplastic material from the sheet which will decrease the length of time a part ejector is disposed in the path of a sheet during the ejecting process.

It is another object of the present invention to provide trimming and ejecting apparatus of the type described which includes toggle linkage mechanism for moving the ejectors.

It is yet another object of the present invention to provide trimming and ejecting apparatus of the type described including ejector rods movable in a to-and-fro path of travel and mechanism for moving the ejector rods including first and second toggle links swingably coupled to each other to at least one trim die about a plurality of axes and movable between opposite sides of a plane intersecting the axes.

A still further object of the present invention is to provide new and novel trimming and ejecting apparatus and method of the type described which includes toggle links and mechanism for yieldably urging the ejectors to a retracted position but allowing forward movement thereof.

A still further object of the present invention is to provide trimming and ejecting apparatus and method of the type described including mechanism for moving the ejectors from a rest position to an ejecting position and return in response to relative movement of the trim dies away from each other and wherein the ejectors remain stationary as the trim dies are oppositely moved to a closed position.

It is another object of the present invention to provide a trimming and ejecting apparatus of the type described which will provide more time to feed the sheet and thus allow a system to operate on a shorter stroke.

It is a further object of the present invention to provide apparatus of the type described which will minimize the wear of the movable machine parts.

Other objects and advantages of the present invention will become apparent to those of ordinary skill in the art as the description thereof proceeds.

SUMMARY OF THE INVENTION

Apparatus for severing and ejecting an article which has been integrally formed in a thermoplastic sheet, from the sheet comprising, a pair of opposed trim dies mounted for relative movement toward and away from each other between closed positions engaging opposite sides of a sheet to trim an article in a sheet from a sheet at a trim station and retracted spaced apart positions allowing the sheet to be indexed therebetween, and ejector mechanism, received by one of the trim dies, movable relative thereto, between a retracted rearward rest position and a forward ejecting position, for ejecting the severed article from the trim station and moving the trimmed article downstream relative to the trim dies; and ejector moving mechanism for moving the ejector mechanism between the retracted position and the forward ejecting position including mechanism responsive to rearward movement of the trim die for initiating forward movement of the ejector, mechanism for accelerating the forward movement of the ejector at a predetermined higher velocity and mechanism for retracting the ejector from the forward ejecting position to the rest position at a still higher predetermined velocity.

DESCRIPTION OF THE DRAWINGS

The invention may be more readily understood by referring to the accompanying drawings, in which.

DESCRIPTION OF THE PREFERRED EMBODIMENT

Trim press apparatus, constructed according to the present invention, generally designated 10, includes a frame, generally designated F, comprising pairs of laterally spaced apart upstanding posts 12 mounting laterally spaced apart pairs of upper and lower side rails 16 spanned by transverse frame members 18.

Figure 6:
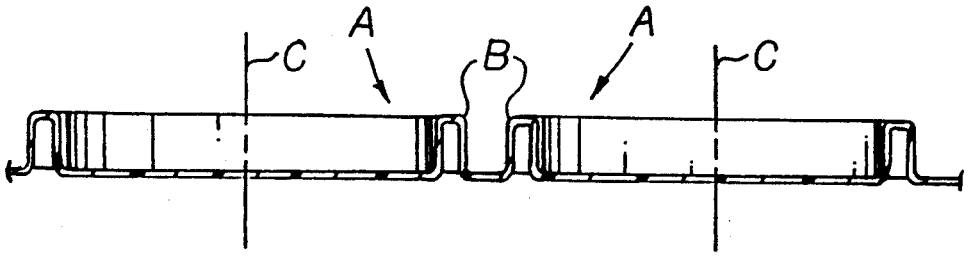
FIG. 6 is a greatly enlarged sectional end view more particularly illustrating a sheet of thermoplastic material having parts thermoformed therein, taken along the line 6—6 of FIG. 7.
Figure 7:
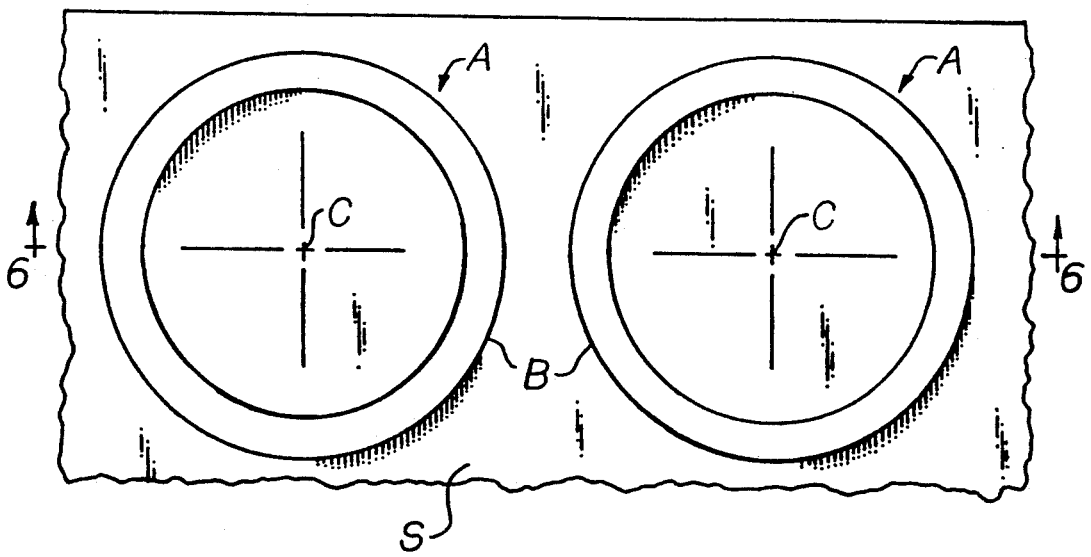
FIG. 7 is a top plan view of a sheet of thermoplastic material illustrated in FIG. 6.

The trim press 10 is particularly adapted for severing and stacking articles, such as containers, generally designated A, (FIG. 6 and 7) which have been differentially pressure formed in a sheet of thermoplastic material, generally designated 5, by thermoforming apparatus such as that disclosed in U.S. Pat. No. 3,664,791 granted to G. W. Brown on May 23, 1972, which is incorporated herein by reference. The articles A may suitably comprise thermoformed, thermoplastic lids and the like conventionally used in coffee vending machines and/or dinner plates.

The trim press includes sheet feed mechanism, generally designated 24, for successively vertically indexing the sheet S downwardly to a trim station, generally designated 26. The sheet feed mechanism 24 operates to successively index the sheet S to successively present articles A at the trim station and thence downwardly.

A pair of opposed primary and secondary trim die assemblies, generally designated 28 and 29, are movably mounted on the frame F for trimming the articles A from the sheet S at the trim station 26. If desired, the trim die assemblies may be dynamically balanced by apparatus disclosed in U.S. Pat. No. 4,313,358.

A sheet indexing drive assembly, generally designated 32, is provided for intermittently, downwardly indexing the sheet S and relatively driving the trim die members 28 and 29 in timed relation. An accumulator or stacker, generally designated 31, is provided for receiving the articles A in nested relation after they have been severed from the sheet S.

THE SHEET SUPPLY supply apparatus 24 includes a pair of laterally spaced, upstanding frame posts 34 mounted on the side rails 14. The posts 34 are spanned by upper and lower cross bars 36 which mount a generally planar, vertical sheet guide plate 38 against which the thermoplastic sheet S bears as it is moved downwardly in a vertical path of travel to the trim station 26.

Apparatus is provided for intermittently downwardly indexing the sheet S along the sheet guide plate 38 and includes a pair of vertical sheet guide rods 40, depending from the upper cross bar 36. Guide sleeves 43, slidably mounted on the guide rods 40, are spanned by a bar 44 having a pair of resilient, yieldable sheet engaging fingers 46 mounted thereon. The fingers 46, which may typically comprise spring steel, include terminal edges 48 which bear against the side U of the sheet S to move the sheet S downwardly in a manner to become immediately apparent.

Figure 3:
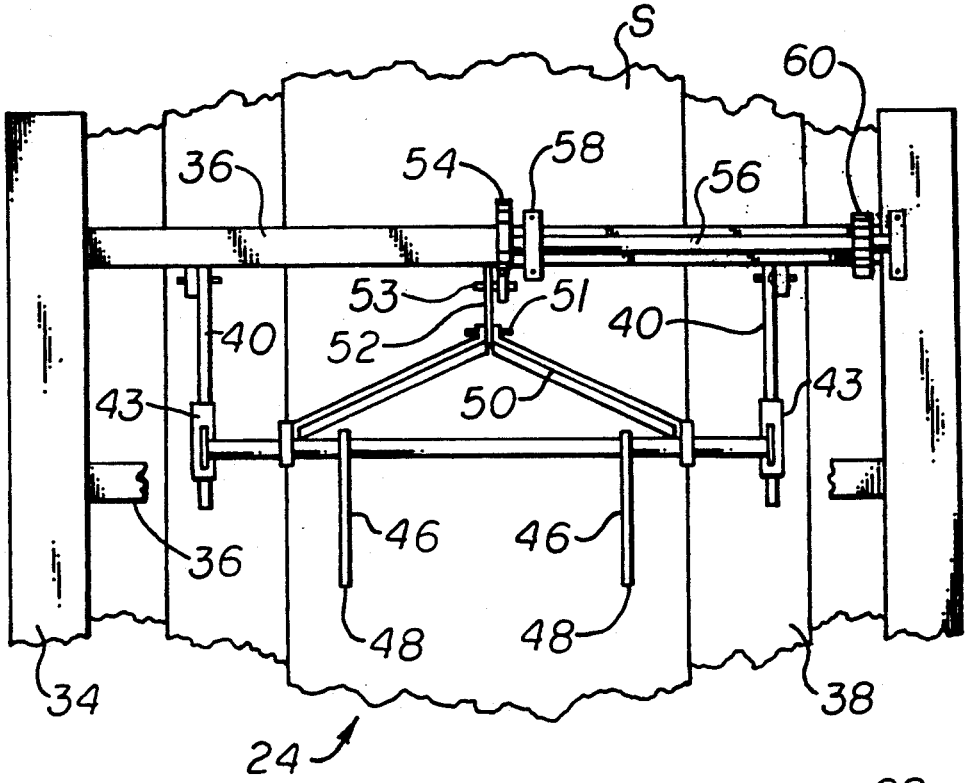
FIG. 3 is a sectional, front end elevational view, taken along the line 3—3 of FIG. 2.

Apparatus is provided for moving the sleeves 43, finger mounting cross bar 44, and sheet engaging fingers 46 upwardly and downwardly and includes a yoke 50 which is fixed to the finger mounting cross bar 44. The yoke 50 is pivotally coupled via a pin 51 (FIG. 3) to one end of a drive arm 52 which is journaled, at its opposite end, on a pin 53 provided on a crank 54 which is fixed to a shaft 56. Bearing blocks 58, mounted on the upper cross bar 36, journal the shaft 56.

A drive sprocket 60 fixed to the shaft 56, is driven via a timing belt or chain 62. As the crank 54 rotates, the finger mounting cross bar 44 and sheet engaging fingers 46 are moved in a vertical path between raised positions, illustrated in chain lines in FIG. 2, and lowered positions illustrated in solid lines in FIG. 2. As the sheet engaging fingers 46 move vertically downstream, the terminal finger edges 48 will engage side U of the sheet S to move the sheet S downwardly along the sheet guide backing plate 38 to successively index the sheet S to the trim station 26 and thence downwardly for discharge.

As the sheet engaging fingers 46 move upwardly, the fingers 46 will merely escape or slide along the surface U of the sheet S which remains in position to which it was previously advanced by the fingers 46.

THE PRIMARY TRIM DIE ASSEMBLY

Figure 1:
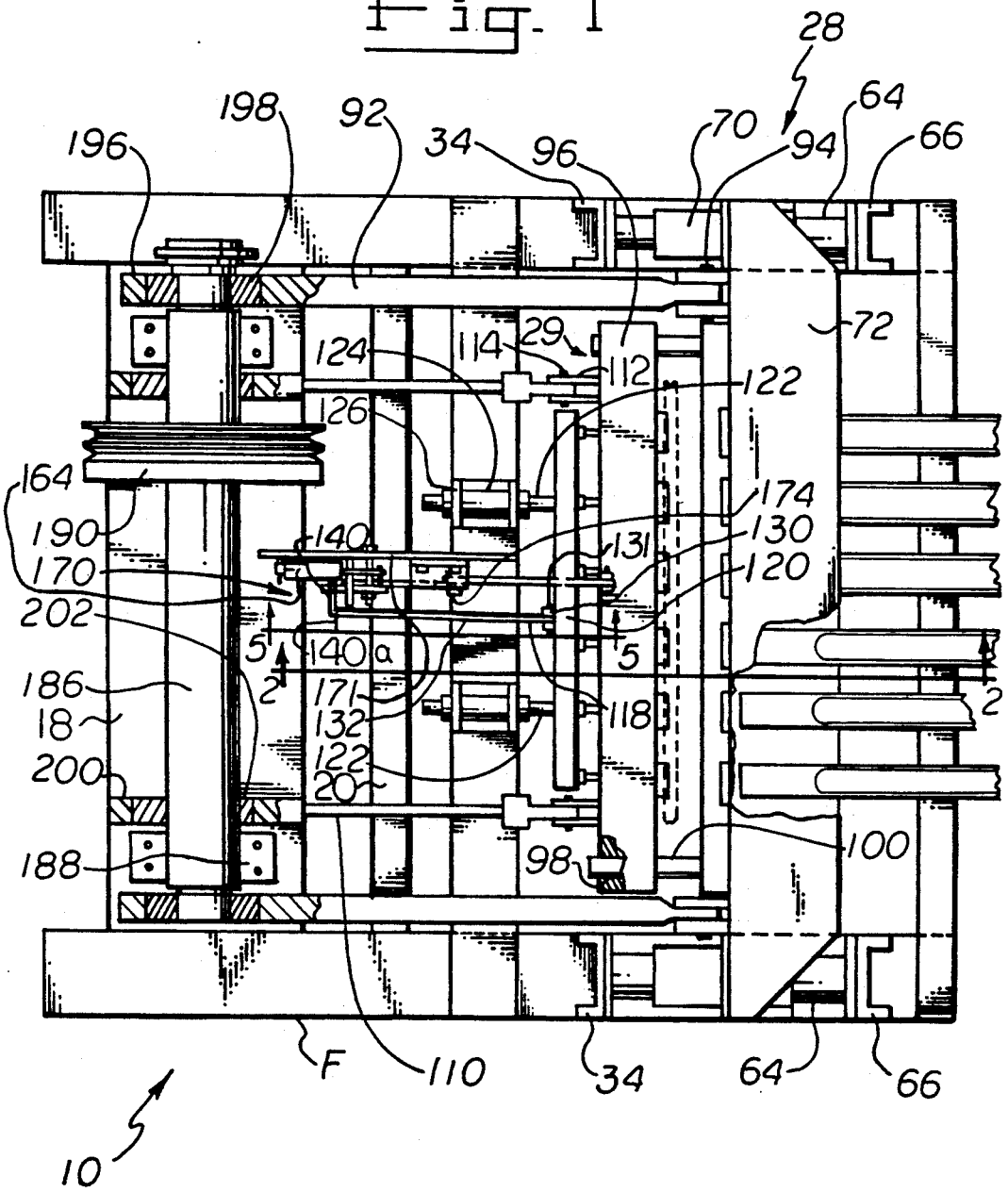
FIG. 1 is a top plan view of apparatus constructed according to the present invention, part of one of the trim die members being broken away to more particularly illustrate the receiver tubes which receive the severed articles, and other parts being broken away in sections to better illustrate the drive apparatus.
Figure 2:
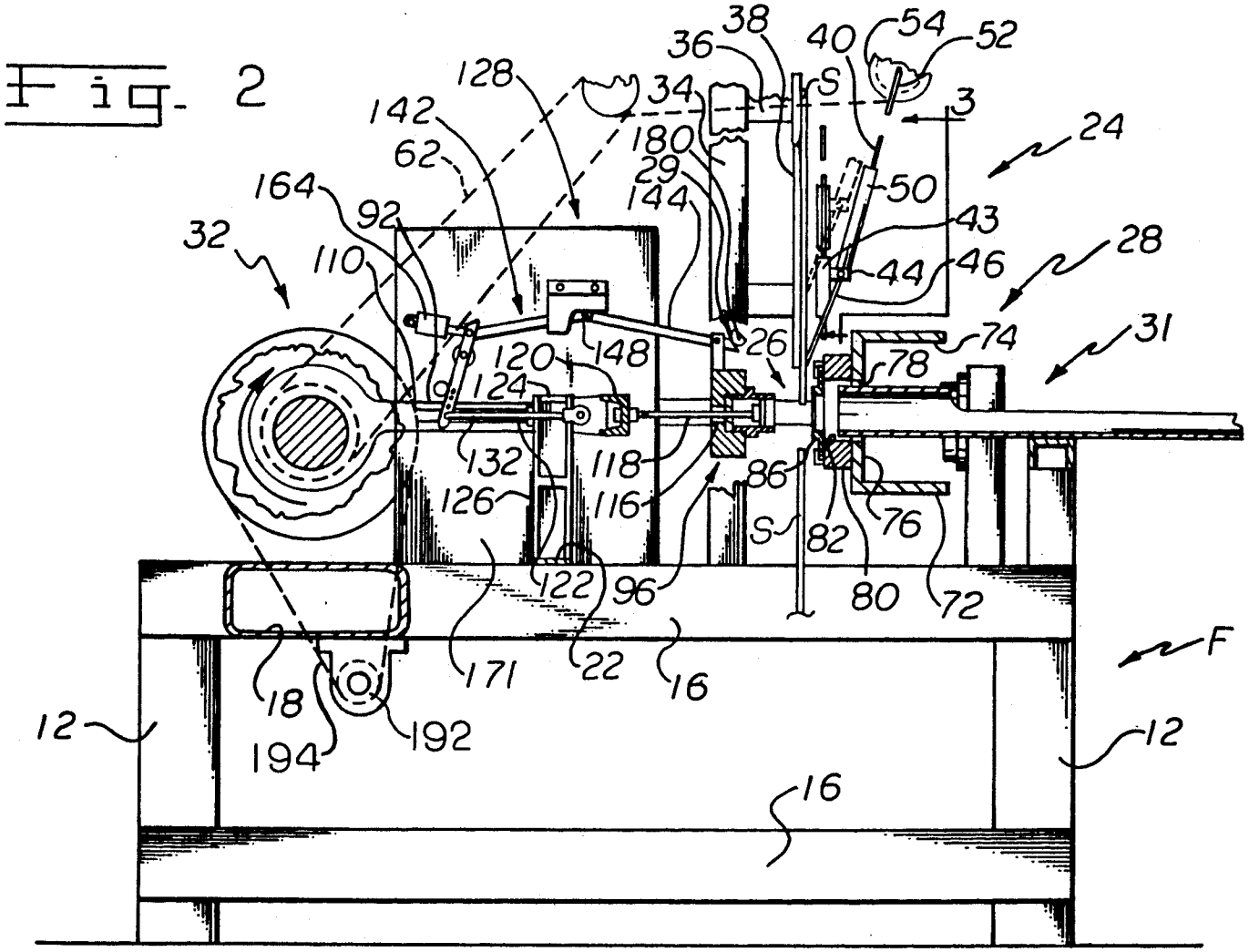
FIG. 2 is a sectional side elevational view taken along the line 2—2 of FIG. 1.

The primary trim die assembly, generally designated 28, is mounted on laterally spaced apart, horizontal guide rods 64 spanning the upstanding frame posts 34 and laterally spaced upstanding stub posts 66 (FIG. 1) mounted on the upper side rails 14. The trim die assembly 28 includes a primary platen, generally designated 72, having guide sleeves 70 slidably, reciprocally mounted on the guide rods 64. The primary die platen 72 is generally U-shaped in cross section, as illustrated in FIG. 2, and includes upper and lower generally parallel flange members 74 spanned by a generally vertical base 76 having a laterally extending, elongate slot opening or aperture 78 therethrough.

Mounted on the base 76 of the primary platen 72 is a primary trim die 80 including a plurality of laterally spaced apart apertures 82 therethrough in alignment with the slot 78. The apertures 82 are spaced apart a distance equal to the distance between the center lines C (FIG. 7) of the adjacent articles A formed in the sheet S.

Mounted on the outer face 84 of the primary die 80 in alignment with each of the apertures 82 is a hollow, generally cylindrical, primary trim die knife 86 having an annular knife edge 88 for engaging one side of the sheet S along the circumferential border B (FIG. 7) of an article A provided in the sheet S. The trim die knife 86 includes a cylindrical passage 90 therethrough which, along with the platen aperture 78, receives the article A as it is being trimmed from the sheet S.

The primary die assembly 28 is moved in a to-and-fro path of travel on the guide rods 64 via two laterally spaced crank arms 92 which are pivotally connected to the primary die platen 72 via pins 94 (FIG. 1) and driven in a manner to be more particularly described hereinafter.

THE SECONDARY TRIM DIE ASSEMBLY

Figure 4:
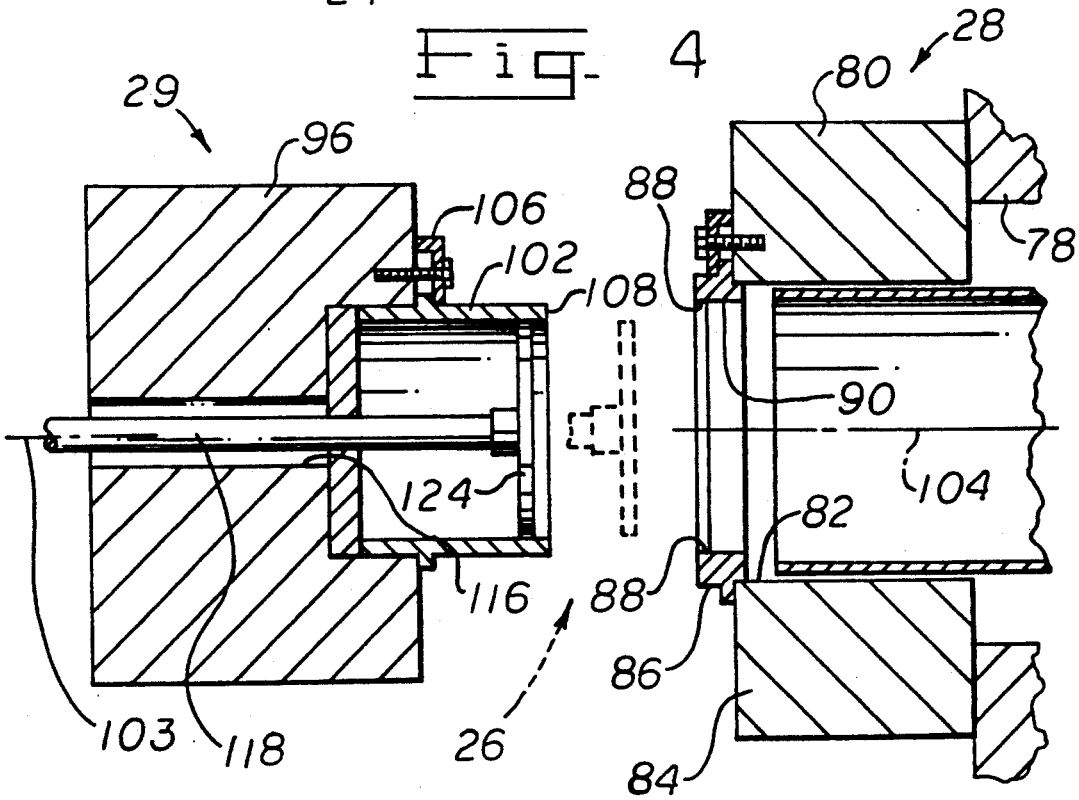
FIG. 4 is a greatly enlarged side elevational view, similar to FIG. 2, illustrating the die members.

The secondary trim die assembly 29 includes a secondary platen 96 having bushings 98 (FIG. 1) therethrough slidably mounted on horizontal guide rods 100 projecting horizontally from the primary die member 80. The secondary platen 96 mounts a plurality of secondary, hollow, cylindrical trim die punches 102 having axes 103 (FIG. 4) axially aligned with the axes 104 of the primary trim die knives 86. The secondary trim die punches 102 are mounted on the face of the secondary platen 96 via mounting brackets 106 (FIG. 4). The secondary trim die punches 102 each comprise a generally hollow cylinder having an annular knife edge 108 which bears against the opposite side of the sheet S and are received in sliding engagement by primary, cylindrical die knives 86 after the article A is severed from the sheet S. The secondary die platen 96 is moved in a to-and-fro path relative to the primary die platen 72 via a pair of laterally spaced, driven crank arms 110 pivotally connected to the secondary die member 96 via brackets and pins.

THE EJECTOR MECHANISM

The secondary die platen 96 includes a plurality of reduced diameter apertures 116 therethrough in axial alignment with the secondary trim die cutting knives, receiving a plurality of ejector pins or bars 118 which are fixed to an ejector pin mounting member or channel 120. The ejector pin mounting channel 120 is fixed to a pair of guide rods 122 which are slidably received in two sleeves 124 mounted on upstanding posts 126 that are fixed to the transverse frame member 22. The ejector pins 118 typically mount terminal ejector plates 119 which are received by the cylindrical die knives 102.

The ejector pin mounting member 120 and ejector pins 118 are concurrently movable relative to the die member via apparatus, generally designated 128, mounted on an upstanding frame plate 171.

The apparatus 128 comprises a longitudinally extending ejector bar 132 which is coupled at its forward end via a bracket 130 and a pivot pin 131 to the ejector pin mounting channel 120. The bar 132 also includes an offset rear end swingably received by any selected one of a plurality of vertically spaced apertures 138 provided in the lower end portion 134 of a trip lever 136 which is swingably mounted on the frame plate 171 via a pivot pin 137. The length of the ejecting stroke of ejector bar 132 and ejector pins 118 can be adjusted depending on which of the apertures 138 the offset end is received. The ejector pins 118 are slidingly received by the apertures 116 provided in the platen 96 to allow the platen 96 to move forwardly relative thereto.

Figure 5A:
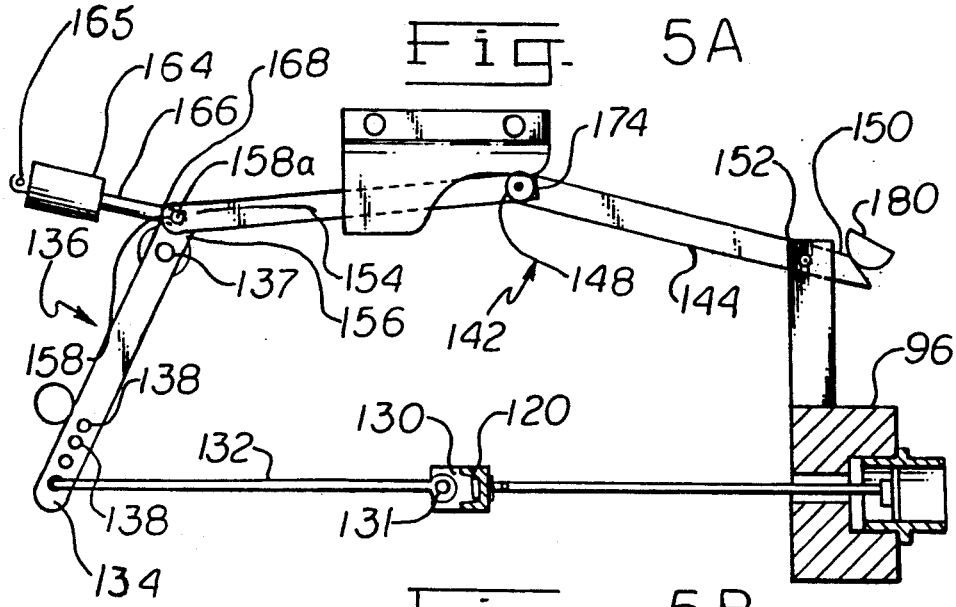
FIG. 5A is a greatly enlarged, sectional side view of the ejector mechanism, taken along the line 5—5 of FIG. 1.
Figure 5B:
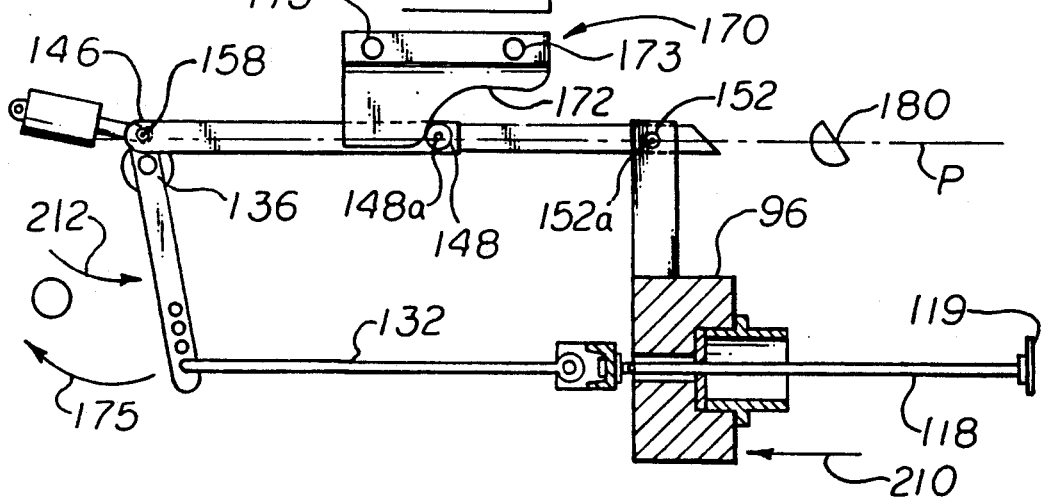
FIG. 5B and 5C are greatly enlarged sectional side elevational views similar to FIG. 5A but illustrating the ejector mechanism in sequential positions during an operating cycle.

The trip lever 136 is swung in a to-and-fro path of travel between the normal rest position, illustrated in FIG. 5A, and a forward ejecting position, illustrated in FIG. 5B, via toggle linkage mechanism, generally designated 142. The toggle linkage mechanism 142 includes a pair of toggle links 144 and 146 swingably coupled together about an axis **148*a* via a pivot pin 148. The forward end 150 of toggle link 144 is swingably coupled about an axis 152*a* to the secondary platen 96 via a pivot pin 152. The rear end 154 of rear link 146 is pivotally coupled to the upper end 156 of trip lever 136 for swingable rotation relative thereto about the axis 158*a* of a pivot pin 158**.

Figure 5C:
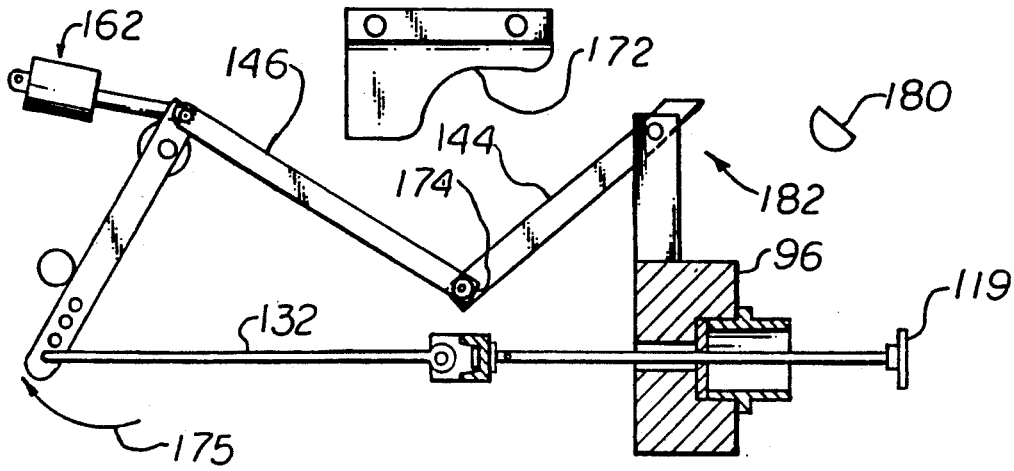

Apparatus, which functions as a spring and is generally designated 162, is coupled to the upper end 156 of trip lever 136 and comprises a double acting, pneumatically operated, air spring cylinder 164 which is pivotally mounted on frame plate 171 via a pivot pin 165 includes a piston rod 166 that is pivotally connected at 168 to the upper lever end 156. Pressurized air is admitted to one end of the cylinder 164 to yieldably urge the piston rod 166 and upper end 156 forwardly to yieldably urge the trip lever 136 to the retracted position illustrated in FIGS. 5A and 5C, in which the ejector bar 132 is fully retracted but allowing swinging movement of the trip lever 136 to the forward ejecting position, illustrated in FIG. 5B. The air operated cylinder 164 also has a cushion at its forward end of travel to dampen any violent piston action. The piston rod 166, which is normally in its full forward position, exerts constant forwardly directed force on upper trip lever end 156, and thus acts as a spring. The air cylinder 164 and piston rod 166 also function as a spring to cushion the return to the initial starting position.

The toggle linkage mechanism 142 is rearwardly bodily moved with the secondary platen 196 from the full forward position, illustrated in FIG. 5A, in response to rearward or retracting movement of the movable die assembly 96. Apparatus is provided for forcing the toggle links 144, 146 from the relatively folded positions, illustrated in FIG. 5A to the oppositely folded positions, illustrated in FIG. 5C. When the trip lever 136 is in the normal forward position, illustrated in FIG. 5A, the toggle links 144 and 146 are partially folded, as illustrated in FIG. 5A, so as to lie on the upper side of a plane P intersecting the axes 148a, 152a and 158a of coupling pins 148, 152 and 158, respectively. A cam, generally designated 170, is mounted on a frame supported, upstanding plate 171 and includes a camming surface 172 which is engaged by a cam roller 174 mounted on the rearwardly moving toggle link pivot pin 148. It should also be noted that a cam having a different profile can be substituted for the cam 170 to change the ejection speed. The cam 170 is also movable on the frame plate 171 via suitable bolts 173.

As the secondary platen 96 moves rearwardly from the position, illustrated in FIG. 5A, to the position illustrated in FIG. 5B, the links 144 and 146 are cammed downwardly to a "dead center" position, illustrated in FIG. 5B, in which the trip lever 136, ejector bar 132 and the ejector pins 118 are in their full forward article ejecting positions. As the platen 96 thereafter continues to move rearwardly to its retracted position, the cam roller 174 will force the toggle links 144 and 146 "over-center" position to an oppositely folded condition, illustrated in FIG. 5C. As soon as the links 144 and 146 pass to the opposite or lower side of the plane P, the spring apparatus 162 will rapidly force the trip lever 136 to rapidly swing oppositely, in the direction of the arrow 175, to even more rapidly retract the ejector bar 132, ejector channel 120, and ejector pins 118 to a position out of the path of sheet S which can then be downwardly indexed.

The platen 96 will then return from the retracted position (FIG. 5C) to the closed position engaging the sheet S, (FIG. 5A) but the ejector rod 132, due to the lost motion connection, will not move forwardly therewith but rather will remain stationary. As the platen 96 cycles forwardly, the toggle links 144 and 146 will unfold from the oppositely folded positions, illustrated in FIG. 5C, as they are carried forwardly with the platen 96. A spring or urethane bumper, generally designated 180, is mounted on the frame F in the path of the forward end 150 of the link 144. As the link 144 approaches its final forward end of travel, the bumper 180 will force the forward link end 150 clockwisely, as illustrated in FIG. 5A, in the direction of the arrow 182, and thus force the links 144 and 146 to return to the folded initial positions on the upper side of the plane P.

THE DRIVE ASSEMBLY

The drive assembly 32 for operating the sheet supply mechanism 24 and trim die assemblies 28, 29 in timed relation includes a transverse shaft 186 journaled in bearings 188 mounted on the frame member 18. The shaft 186 mounts a drive pulley 190 drivingly coupled to an electrical energized motor via a belt. The crank arms 92 for moving the primary die assembly 28 including the primary platen 72 are coupled to sleeves 196 journaled on eccentric cams 198 fixed to the shaft 186. As the shaft 186 and eccentric cams 198 rotate, the crank arms 92 will move the primary platen 72 in a to-and-fro path of travel on the guide rods 64.

The crank arms 110 for moving the secondary die assembly 29, including the secondary die platen 96 relative to the primary platen 72, are coupled to sleeves 200 journaled on eccentric cams 202 fixed to the shaft 186. The eccentric cams 198 and 202 are constructed such that the die assemblies 28, 29 will concurrently move in opposite directions toward and away from each other on opposite sides of the sheet S.

THE METHOD AND OPERATION

A thermoplastic sheet S, having a plurality of laterally and longitudinally spaced articles A thermoformed therein, is vertically downwardly fed into the machine along the backing plate 38. It will be assumed that the feed assembly 24 has been operated to move the sheet S downwardly to a position in which articles A are axially aligned with the hollow trim die knife members 86 and punches 102 at the trim die station 26. At this time, the primary and secondary die assemblies 28 and 29 are in their retracted spaced apart positions and the toggle links 144 and 146 are in partially folded positions on the upper side of plane P. As the drive assembly 32 continues to operate, the primary die knives 86 and secondary upper die punches 102, along with the primary and secondary die assemblies 28 and 29, will be driven toward each other to engage opposite sides of the sheet S. The sheet S will be pinched therebetween and the sheet S will thereby be severed along the borders B to separate the articles A positioned at the trim station 26 from the sheet S.

The drive assembly 32 will continue to operate to move the primary die knives 86 and secondary punches 102 until the male die punches 102 are received by the cylindrical female primary die knife members 96 as more particularly described in U.S. Pat. No. 4,313,358.

As the drive assembly continues to operate, the die assembly 29 will start to retract in the opposite direction represented by the arrow 210. As the retraction of the die assembly 29 occurs, the links 144 and 146 will be moved rearwardly therewith away from the position illustrated in FIG. 5A.

With continued movement of the die assembly 29, the cam roller 174 and cam surface 172 will downwardly force the joined ends of toggle links 144 and 146 so that the toggle links 144 and 146 are in the "dead center positions" illustrated in FIG. 5B in which the toggle link coupling axes 148, 152 and 158 all lie in the plane P. At this stage, the links 144, 146 will have forced the trip lever 136 to swing forwardly in the direction of the arrow 212 thereby moving the ejector rod 132 and ejector pins 118 to the full forward ejecting positions.

The initial rearward movement of the secondary trim die assembly 29 and platen 96 is quite slow and thus the ejector plates 119 initially gently engage the just severed articles A, at a relatively low velocity. As the die assembly 29 retracts, the velocity of assembly 29 increases and thus the forward swinging motion of the lever 136 in the direction of arrow 212 concurrently increases. In addition, the links 144 and 146, being cammed from folded positions to the "dead center" position, further contributes to the increasing velocity of the swinging movement of the trip lever 136 and the velocity ejectors 118 moved thereby.

The upper pivot pin 137 of trip lever 136 is much closer to the axis 158a than it is to the axes of the apertures 138 at the lower end 134 of the lever 136 so that the forward displacement of ejector rod 132 and ejector pins 118 is substantially greater than the concurrent rearward displacement of the upper lever end 156. This also contributes to the substantially increased forward velocity of pins 118 until they reach their final full forward ejecting positions, illustrated in FIG. 5B.

When the links 144 and 146 are in their "dead center" positions, as illustrated in FIG. 5B, the ejector bar 132 and ejector pins 118 are in their forwardmost ejecting positions. When the toggle links 144 and 146 pass to the underside of the plane P, the spring apparatus 162 will force the trip lever 136 to swing rapidly oppositely, in the direction of the arrow 175, retracting the ejector rods and ejector pins 118 in a rearward direction represented by the arrow 210 at a still higher velocity.

As the drive assembly 32 continues to operate, the platen 29 will again be returned from the full rearward position to the forward closed position. As the platen 96 again moves forwardly, the ejector rod 136 will remain in the retracted position illustrated in FIG. 5C. As the platen 96 again moves to the closed sheet engaging position, the toggle links 144 and 146 will be drawn forwardly and will upwardly unfold and return to the relative positions, illustrated in FIG. 5B. As the front lever end 182 engages the urethane bumper 180, the toggle link 144 will be cammed upwardly to the initial folder starting position on the upper side of plane P as illustrated in FIG. 5A. The operation will be repeated.

It should be noted that as the platen 96 moves rearwardly, the spring apparatus 162 yieldably urges the trip lever to remain in the position, illustrated in FIG. 5A, so that the ejectors 118 are yieldably urged to the retracted rest position, illustrated in FIG. 5A, but allows the trip lever 136 to swing forwardly in the direction of arrow 212, to an ejecting position in which the ejector pins 118 project forwardly of the male die punches 102.

The length of the ejector stroke can be adjusted by changing the lever hole in which the offset end 140 of ejector bar 132 is received.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for trimming and ejecting articles integrally thermoformed in a sheet of thermoplastic material from the sheet comprising:

a frame;

means for indexing a sheet of thermoplastic material having articles thermoformed therein to a trim station;

a pair of opposed trim dies mounted on said frame for relative movement toward and away from each other between a closed position engaging opposite sides of said sheet to trim an article in said sheet from said sheet at said trim station and a retracted spaced apart position allowing the sheet to be indexed therebetween; and ejector means received by one of said trim dies and movable relative thereto, between a retracted, rearward rest position and a forward ejecting position for ejecting a severed article from said trim station and moving the severed article relative to said trim dies;

ejector moving means for moving said ejector means between said retracted position and said forward ejecting position including means responsive to said relative movement of said trim dies away from each other for initiating forward movement of said ejector means at a predetermined velocity;

means for accelerating the forward movement of said ejector means at a predetermined higher velocity; and means for retracting said ejector means from said forward ejecting position to said rest position at a still higher predetermined velocity;

means for moving one of said dies between said closed position and said retracted position;

said ejector moving means being mounted on said frame and coupled to said one trim die and to said ejector means such that said ejector means is moved forwardly from said retracted rest position to said forward ejecting position in response to rearward movement of said one trim die from said closed position to said retracted position;

said ejector moving means comprising toggle linkage means coupled to said one trim die for movement therewith and for movement relative thereto.

2. The apparatus set forth in claim 1 wherein said toggle linkage means include first and second toggle links pivotally coupled about a first axis, said first toggle link being pivotally coupled to said one trim die for movement about a second axis, said second toggle link being pivotally coupled to said ejector means for movement about a third axis.

3. The apparatus set forth in claim 2 wherein said ejector moving means includes an actuator bar pivotally mounted on said frame and being pivotally coupled to said ejector means and to said second toggle link.

4. The apparatus set forth in claim 2 wherein said ejector moving means includes an actuator lever having one end pivotally coupled to said ejector means for relative movement about a fourth axis and a second end pivotally coupled to said second toggle link for relative movement about said third axis, and means pivotally mounting a portion of said lever between said one end and said second end on said frame for pivotal movement about a fifth axis.

5. The apparatus set forth in claim 4 wherein said first and second toggle links are relatively movable between partially folded positions on one side of a plane intersecting said first, second and third axes and over-center positions on the opposite side of said plane.

6. The apparatus set forth in claim 4 wherein the distance between said fourth axis and said fifth axis is substantially greater than the distance between said third axis and said fifth axis.

7. The apparatus set forth in claim 6 wherein said lever includes mount means for coupling said lever to said ejector means at any selected one of a plurality of different locations to selectively adjust the distance between said fourth and fifth axes.

8. Apparatus for trimming and ejecting articles integrally thermoformed in a sheet of thermoplastic material from the sheet comprising:

a frame;

means for indexing a sheet of thermoplastic material having articles thermoformed therein to a trim station;

a pair of opposed trim dies mounted on said frame for relative movement toward and away from each other between a closed position engaging opposite sides of said sheet to trim an article in said sheet from said sheet at said trim station and a retracted spaced apart position allowing the sheet to be indexed therebetween; and ejector means received by one of said trim dies and movable relative thereto, between a retracted, rearward rest position and a forward ejecting position for ejecting a severed article from said trim station and moving the severed article relative to said trim dies;

ejector moving means for moving said ejector means between said retracted position and said forward ejecting position including means responsive to said relative movement of said trim dies away from each other for initiating forward movement of said ejector means at a predetermined velocity;

means for accelerating the forward movement of said ejector means at a predetermined higher velocity; and means for retracting said ejector means from said forward ejecting position to said rest position at a still higher predetermined velocity;

said ejector moving means comprising a lever having first and second ends and a portion between said first and second ends pivotally mounted on said frame to allow said lever to pivotally move between an ejector advance position and an ejector retract position; means coupling said first end of said lever to said ejector means; yieldable means yieldably urging said lever to said ejector retract position but allowing movement thereof to said ejector advance position; and toggle linkage means coupled between one trim die and said second end of said lever for moving said lever from said ejector retract position to said ejector advance position to move said ejector means between said retracted rest position and said forward ejecting position.

9. The apparatus set forth in claim 8 wherein said toggle linkage means includes first and second toggle links pivotally coupled together for pivoting movement about a first axis, said first link being pivotally coupled to said one trim die for pivoting movement about a second axis, said second link being pivotally coupled to said second end of said lever for relative pivoting movement about a third axis; and said toggle links being relatively movable between ejector retracting positions on one side of a plane intersecting said first, second and third axes, dead-center ejector advancing positions in which said first, second and third axes lie in said plane, and over-center ejector retracting positions in which said links are on the opposite side of said plane.

10. The apparatus set forth in claim 9 wherein said yieldable means is operable to return said lever to said ejector retract position when said first and second toggle links are in said over-center positions to retract said ejector means to said retracted position.

11. The apparatus set forth in claim 9 including means for moving said links between said ejector retracting positions on said one side of said plane and said ejector retracting positions on said opposite side of said plane.

12. The apparatus set forth in claim 9 including cam means disposed in the path of a portion of said toggle linkage means as said one die retracts from said closed position to said retracted position to force said first and second toggle links from said one side of said plane to said opposite side of said plane.

13. The apparatus set forth in claim 12 wherein said yieldable means is operable to return said lever from said ejector advance position to said ejector retract position when said first and second toggle links are disposed in said over-center, ejector retracting positions to retract said ejector means to said rearward rest position.

14. The apparatus set forth in claim 13 including means for moving said first and second toggle links from said over-center positions to said ejector retracting positions on said one side of said plane in response to movement of said one die from said retract position to said closed position.

15. The apparatus set forth in claim 14 wherein said means for moving said first and second toggle links form said ejector retracting, over-center positions on said other side of said plane to said ejector retracting positions on said one side of said plane includes cam means disposed in the path of said first toggle link.

16. Apparatus for trimming articles which are integrally differentially pressure thermoformed in a sheet of thermoplastic material from the sheet and stacking the severed articles comprising:

a frame;

means on said frame for delivering a sheet of thermoplastic material having articles differentially pressure formed therein to a trim station;

first and second trim dies mounted on said frame for relative movement toward and away from each other between a closed position clamped to opposite sides of said sheet to sever articles at said trim station and a removed position allowing the sheet to be moved therebetween;

ejector means received by one of said trim dies and movable relative thereto between a rearward rest position and a forward article ejecting position, for ejecting a severed article from said trim station and moving it downstream relative to said trim dies;

ejector moving means for moving said ejector means between said rearward rest position and said forward ejecting position comprising:

a lever pivotally mounted about a first axis on said frame and having one end pivotally coupled about a second axis to said ejector means; and toggle linkage means coupled to said one trim die for movement therewith and for movement relative thereto; and coupled to the other end of said lever for pivoting said lever in a to-and-fro pivoting path of travel to move said ejector means between said rearward rest position and said forward ejecting position.

17. The apparatus set forth in claim 16 wherein said toggle linkage means for pivoting said lever comprises first and second toggle links each having one end pivotally coupled to said one end of the other toggle link for relative pivotal movement about a third axis; said first toggle link having an opposite end pivotally coupled to said one trim die for movement therewith and for relative pivotal movement about a fourth axis; said second toggle link having an opposite end pivotally coupled to said other end of said lever for relative pivoting movement about a fifth axis.

18. The apparatus set forth in claim 17 wherein said toggle links are relatively movable between folded positions on one side of a plane intersecting said third, fourth and fifth axes and oppositely folded positions on the other side of said plane.

19. The apparatus set forth in claim 18 including means on said frame disposed in the path of said toggle links for moving said first and second toggle links between said folded positions on said one side of said plane and said oppositely folded positions on said other side of said plane as said dies move between said closed position and said removed position.

20. The apparatus set forth in claim 19 including yieldable means on said frame for urging said lever to a first position in which said ejector means is in said rest position but allowing pivoting movement thereof to a second position in which said ejector means is in said ejecting position.

21. Apparatus for trimming articles which are integrally differentially pressure thermoformed in a sheet of thermoplastic material from the sheet and stacking the severed articles comprising:

a frame;

means on said frame for delivering a sheet of thermoplastic material having articles differentially pressure formed therein to a trim station;

first and second trim dies mounted on said frame for relative movement toward and away from each other between a closed position clamped to opposite sides of said sheet to severe articles at said trim station and a removed position allowing the sheet to be moved therebetween;

ejector means received by one of said trim dies and movable relative thereto between a rearward rest position and a forward article ejecting position, for ejecting a severed article from said trim station and moving it downstream relative to said trim dies;

ejector moving means for moving said ejector means between said rearward rest position and said forward article ejecting position comprising:

first and second toggle links each having one end pivotally coupled to said one end of the other toggle link for pivoting movement about a first axis;

said first toggle link including an opposite end pivotally coupled to said first trim die for movement therewith and for pivoting movement relative thereto about a second axis;

said second toggle link including an opposite end pivotally coupled to said ejector means for movement therewith and for pivoting movement relative thereto about a third axis; and means on said frame for moving said toggle links between relatively folded positions on one side of a plane intersecting said first, second and third axes and oppositely relatively folded positions on the opposite side of said plane as said trim dies relatively move between said closed positions and said removed positions.

22. The apparatus set forth in claim 21 wherein said means for moving said toggle links includes cam means mounted on said frame.

23. The apparatus set forth in claim 22 including yieldable means normally urging said ejector means to said rest position but allowing movement thereof in a direction toward said ejecting position when said dies move from said closed position to said removed position.

24. Apparatus for trimming and ejecting articles integrally thermoformed in a sheet of thermoplastic material from the sheet comprising:

a frame;

means for indexing a sheet of thermoplastic material having articles thermoformed therein to a trim station;

a pair of opposed trim dies mounted on said frame for relative movement toward and away from each other between a closed position engaging opposite sides of said sheet to trim an article in said sheet from said sheet at said trim station and a retracted spaced apart position allowing the sheet to be indexed therebetween; and ejector means received by one of said trim dies and movable relative thereto, between a retracted, rearward rest position and a forward ejecting position for ejecting a severed article from said trim station and moving the severed article downstream relative to said trim dies;

ejector moving means operable between a first position and a second position for moving said ejector mans in a forward direction from said retracted rest position to said forward ejecting position at a predetermined maximum velocity and for returning said ejector means to said retracted rest position at a higher velocity; and yieldable means on said frame for yieldably urging said ejector moving means to said first position in which said ejector means is in said retracted rest position but allowing movement of said ejector moving means to said second position in which said ejector means is in said ejecting position;

said ejector moving means including toggle link means coupled between said one trim die and said ejector means for movement therewith and for movement relative thereto.

25. The apparatus set forth in claim 24 wherein said toggle link means is operable in response to movement of said one trim die from said closed position to said retracted position to move said ejector moving means from said first position to said second position.

26. The apparatus set forth in claim 25 wherein said ejector means includes an article pusher member mounted on said one trim die for reciprocal movement thereon in a to-and-fro path of travel between said retracted rest position and said ejecting position; and actuating means mounted on said frame and coupled to said pusher member for moving said pusher member in said to-and-fro path of travel between said rest position and said ejecting position.

27. The apparatus as set forth in claim 26 wherein said actuating means comprises a lever pivotally coupled about a first axis to said article pusher member and pivotally mounted on said frame for to-and-fro pivoting movement about a second axis between said retracted, rearward rest position and said forward ejecting position, said yieldable means reacting between said frame and said lever to yieldably urge said lever to said retracted rest position.

28. The apparatus as set forth in claim 27 wherein said toggle link means includes a pair of toggle links pivotally coupled together for relative pivoting movement about a third axis, one of said links being pivotally coupled to said first trim die for movement therewith and for pivotal movement relative thereto about a fourth axis, and the other of said links being pivotally coupled to said lever for pivotal movement about a fifth axis.

29. The apparatus as set forth in claim 28 including cam means on said frame for relatively moving said links between partially folded positions on one side of a plane intersecting said third, fourth and fifth axes and oppositely folded positions on the opposite side of said plane.

30. Apparatus for trimming and ejecting articles integrally thermoformed in a sheet of thermoplastic material from the sheet comprising:

a frame;

means for indexing a sheet of thermoplastic material having articles thermoformed therein to a trim station;

a pair of opposed trim dies mounted on said frame for relative movement toward and away from each other between a closed position engaging opposite sides of said sheet to trim an article in said sheet from said sheet at said trim station and a retracted spaced apart position allowing the sheet to be indexed therebetween;

ejector means received by one of said trim dies and movable relative thereto, between a retracted, rearward rest position and a forward ejecting position for ejecting a severed article from said trim station and moving the severed article downstream relative to said trim dies;

toggle linkage means coupled to at least one of said trim dies, operable in response to movement of said at least one of said trim dies from said closed position to said retracted position, for moving said ejector means from said retracted rearward rest position to said ejecting position and returning said ejector means to said rest position but allowing said ejector means to remain in said rest position as said one trim die moves forwardly relative to said ejector means between said retracted position and said closed position.

31. The apparatus set forth in claim 30 wherein said ejector means, in said rest position, is a predetermined distance from said sheet at said trim station and said one trim die, in said retracted position, is a substantially greater distance from said sheet at said trim station.

32. Apparatus for trimming and ejecting articles integrally thermoformed in a sheet of thermoplastic material from the sheet comprising:

a frame;

means for indexing a sheet of thermoplastic material having articles thermoformed therein to a trim station;

a pair of opposed trim dies mounted on said frame for relative movement toward and away from each other between a closed position engaging opposite sides of said sheet to trim an article in said sheet from said sheet at said trim station and a retracted spaced apart position allowing the sheet to be indexed therebetween; and ejector mans received by one of said trim dies and movable relative thereto, between a retracted, rearward rest position and a forward ejecting position for ejecting a severed article from said trim station and moving the severed article relative to said trim dies;

ejector moving means for moving said ejector means between said retracted position and said forward ejecting position including means responsive to said relative movement of said trim dies away from each other for initiating forward movement of said ejector means at a predetermined velocity;

means for accelerating the forward movement of said ejector means at a predetermined higher velocity; and means for retracting said ejector means from said forward ejecting position to said rest position at a still higher predetermined velocity;

said ejector moving means comprises toggle linkage means coupled to said one trim die for movement therewith and for movement relative thereto.

* * * * *